US008496239B2

(12) United States Patent
Furuhashi et al.

(10) Patent No.: US 8,496,239 B2
(45) Date of Patent: Jul. 30, 2013

(54) SHEET PROCESSING APPARATUS, IMAGE FORMING SYSTEM, AND SHEET PROCESSING METHOD

(75) Inventors: Tomohiro Furuhashi, Kanagawa (JP); Keisuke Sugiyama, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/313,659

(22) Filed: Dec. 7, 2011

(65) Prior Publication Data

US 2012/0146279 A1 Jun. 14, 2012

(30) Foreign Application Priority Data

Dec. 9, 2010 (JP) ..... 2010-274795

(51) Int. Cl.
*B65H 37/04* (2006.01)

(52) U.S. Cl.
USPC ..... 270/58.09; 270/58.11; 270/58.17; 399/410

(58) Field of Classification Search
USPC ..... 270/58.08, 58.09, 58.11, 58.17; 399/410
See application file for complete search history.

(56) References Cited

U.S. PATENT DOCUMENTS 7,681,881 B2 3/2010 Kunieda et al.
8,297,610 B2 * 10/2012 Shiraishi ..... 270/58.09
2008/0187383 A1 * 8/2008 Yamamoto ..... 399/410
2009/0066003 A1 3/2009 Kunieda et al.
2010/0207314 A1 * 8/2010 Hattori et al. ..... 270/58.09
2010/0219576 A1 * 9/2010 Yamamoto ..... 270/58.08
2011/0103919 A1 5/2011 Furuhashi et al.
2011/0266738 A1 * 11/2011 Furuhashi et al. ..... 270/58.08

FOREIGN PATENT DOCUMENTS

JP 2009242014 A 10/2009
JP 2009242014 A * 10/2009
JP 2010265067 A 11/2010
JP 2011230908 A 11/2011

OTHER PUBLICATIONS

Abstract of JP 2011-230908.

* cited by examiner

*Primary Examiner* — Patrick Mackey
(74) *Attorney, Agent, or Firm* — Harness, Dickey & Pierce, P.L.C.

(57) ABSTRACT

A sheet processing apparatus includes a pair of first aligning members movable in a sheet conveyance direction and a sheet width direction, a pair of second aligning members to align lateral sides of a bundle of sheets, a stapler movable in the sheet width direction to staple a trailing end portion of the bundle, a driving unit to move the first aligning members, and a controller. The first aligning members include a stack portion to contact and support a trailing edge of the bundle. When the stapler staples the bundle at two positions symmetrically relative to a center position in the sheet width direction, the controller selects either first positions inside the two stapled positions or second positions outside the two stapled positions in accordance with multiple stapling-related variables, and the first aligning members are set at the selected positions to align the trailing edge of the bundle.

12 Claims, 15 Drawing Sheets

SHEET PROCESSING APPARATUS, IMAGE FORMING SYSTEM, AND SHEET PROCESSING METHOD

CROSS-REFERENCE TO RELATED APPLICATIONS

This patent application is based on and claims priority pursuant to 35 U.S.C. §119 to Japanese Patent Application No. 2010-274795, filed on Dec. 9, 2010, in the Japan Patent Office, the entire disclosure of which is hereby incorporated by reference herein.

FIELD OF THE INVENTION

The present invention generally relates to a sheet processing apparatus to align and to staple a bundle of sheets, an image forming system including an image forming apparatus such as a copier, a facsimile machine, a printer, or multifunction machine capable of at least two of these functions and the sheet processing apparatus, and a method of processing sheets.

BACKGROUND OF THE INVENTION

Sheet processing apparatuses so-called finishers that perform post-processing such as aligning, sorting, stapling, and/or punching of sheets are widely used. Sheet processing apparatuses typically include a stapling tray, on which sheets, for example, discharged from the image forming apparatus, are stacked, an alignment unit to align the sheets on the stapling tray in the direction (i.e., sheet width direction) perpendicular to the direction in which the sheets are transported (hereinafter "sheet conveyance direction"), a reference fence to align the sheets in the sheet conveyance direction, and a stapler that staples the aligned sheets. The stapler is typically movable in the sheet width direction along a side (typically, the trailing side) of a bundle of sheets that is in contact with the reference fence for stapling an end portion of the bundle (i.e., side stapling). Thus, the stapler is moved for stapling multiple positions of the bundle.

The length of the stapled side of the bundle of sheets differs depending on sheet size or direction of sheets. Accordingly, if the stapler staples sheets at the same positions (hereinafter "stapled positions") regardless of sheet size or direction of sheets in two-position stapling, the interval betweens the two positions stapled is greater in the case of small sheets.

To adjust the interval betweens the stapled positions in two-position stapling, the stapler may be designed to be set at given positions for stapling. This approach, however, has a drawback in that it is possible that the reference fence blocks the stapler moving to an intended position to be stapled and stapling cannot be performed.

In view of the foregoing, for example, in JP-2009-242014-A, the reference fence is designed to move in the sheet width direction to a position not to interfere with the stapler after the sheets are aligned. However, moving the reference fence after alignment of the sheets can disturb alignment of the sheets. Additionally, the position to which the reference fence is moved may be improper for supporting the sheets, making the sheets unbalanced. Thus, it is possible that alignment of the sheets is degraded. Moreover, moving the reference fence after alignment of the sheets causes a downtime in processing, reducing productivity.

BRIEF SUMMARY OF THE INVENTION

In view of the foregoing, one embodiment of the present invention provides a sheet processing apparatus that includes a pair of first aligning members movable in both a sheet conveyance direction in which a bundle of sheets is transported and a sheet width direction perpendicular to the sheet conveyance direction, a pair of second aligning members each extending in the sheet conveyance direction to move in the sheet width direction perpendicular to the sheet conveyance direction to align lateral sides of the bundle, a stapler movable in the sheet width direction perpendicular to the sheet conveyance direction to staple a trailing end portion of the bundle at different positions in the sheet width direction after the bundle is aligned by the pair of first aligning members as well as the pair of second aligning members, a driving unit to move the pair of first aligning members, and a controller communicably connected to the stapler and the driving unit to move the first aligning members. Each of the first aligning members includes a stack portion to contact and support a trailing edge of the bundle to align the trailing edge of the bundle.

When the stapler staples the bundle at two positions symmetrical relative to a center position in the sheet width direction of the bundle, the controller selects either first positions inside the two stapled positions or second positions outside the two stapled positions in accordance with multiple stapling-related variables, and the first aligning members are set at the selected positions to align the trailing edge of the bundle.

Another embodiment provides an image forming system that includes an image forming apparatus to form images on sheets of recording media, and the above-described sheet processing apparatus.

Yet another embodiment provides a method of processing a bundle of sheets. The method includes a step of presetting, as a pair of positions at whish a trailing end portion of the bundle is supported, first positions inside two positions stapled symmetrically relative to a center position in a sheet width direction perpendicular to a sheet conveyance direction and second positions outside the two stapled positions in the sheet width direction according to sheet size and positions of the two stapled positions, a step of selecting either the first positions inside the two stapled positions or second positions outside the two stapled positions in accordance with a stapling-related variable, a step of moving a pair of first aligning members to the either the first positions or the second positions selected before the bundle of sheets are aligned on the sheet support, a step of aligning the bundle of sheets in the sheet conveyance direction with the pair of first aligning members, a step of aligning the bundle of sheets in the sheet width direction with a pair of second aligning members, and a step of stapling the trailing end portion of the bundle of sheets at the two positions.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE INVENTION

Figure 1:
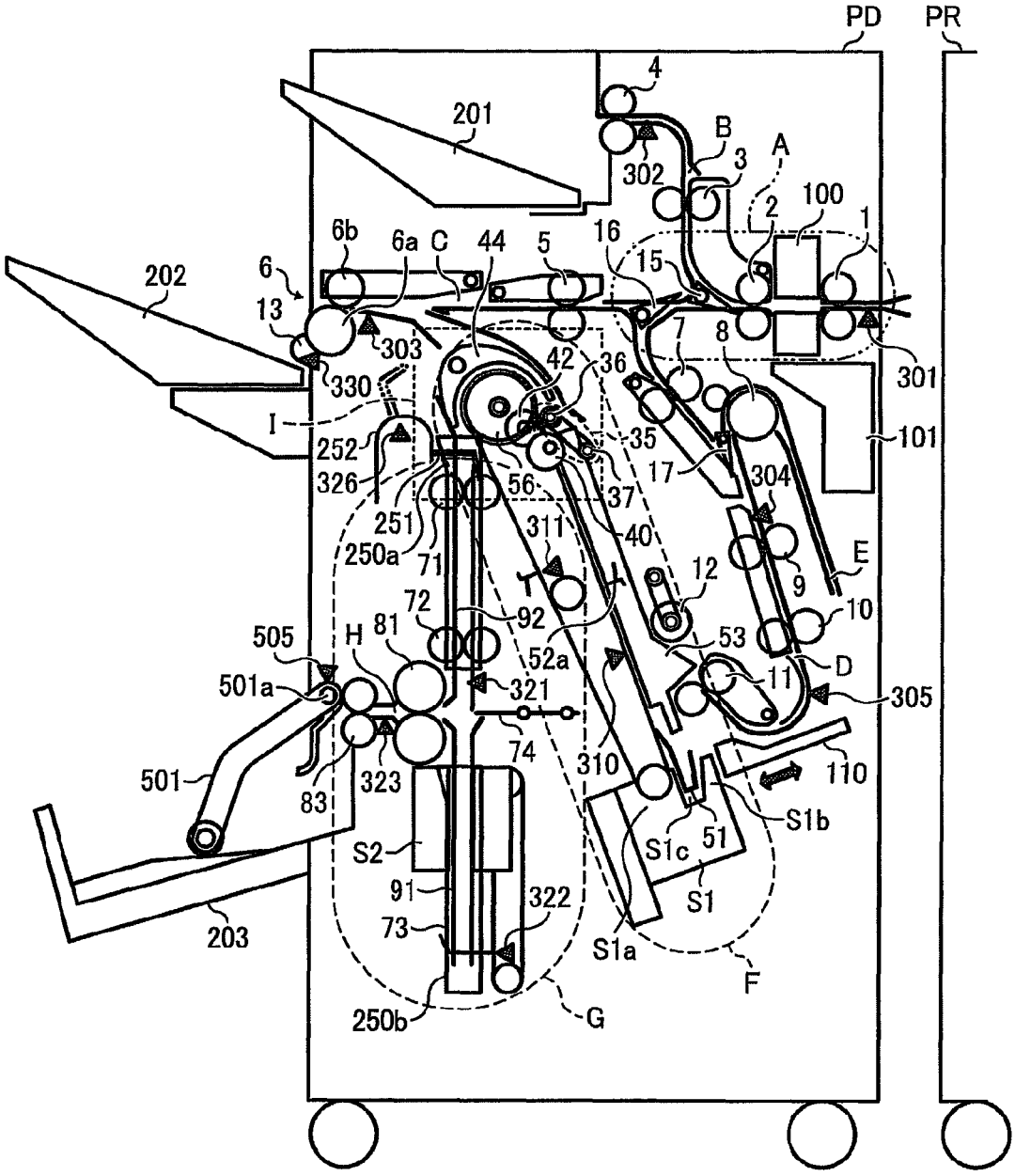
FIG. 1 illustrates a configuration of a system including a sheet processing apparatus and an image forming apparatus.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, a multicolor image forming apparatus according to an illustrative embodiment of the present invention is described.

FIG. 1 illustrates a configuration of a system including a sheet processing apparatus (finisher) PD and an image forming apparatus PR.

The image forming apparatus PR shown in FIG. 1 includes at least an image processing circuit to convert image data input thereto into printable data, an optical writing device to form a latent image on a photoreceptor according to image signals output from the image processing circuit (optical writing), a development device to develop the latent image formed on the photoreceptor into a toner image, a transfer device to transfer the toner image onto a sheet of recording media, and a fixing device to fix the toner image on the sheet. The image forming apparatus PR sends out the sheet on which the image is fixed to the sheet processing apparatus PD. Then, the sheet processing apparatus PD performs post processing of sheets, such as, aligning, sorting, stapling, punching, and folding of sheets. Although the image forming apparatus PR is electrophotographic type in the present embodiment, alternatively, image forming apparatuses of any known type such as ink-ejection type or thermal transfer type may be used. It is to be noted that, the image processing circuit, the optical writing device, the development device, the transfer device, and the fixing device described above together form an image forming unit.

The sheet processing apparatus PD is provided on a side of the image forming apparatus PR, and sheets output from the image forming apparatus PR are conveyed to the sheet processing apparatus PD. Inside the sheet processing apparatus PD, conveyance paths A, B, C, and D, and a discharge path H are formed. The sheet transported from the image forming apparatus PR is initially conveyed to the conveyance path A along which a punch unit 100 serving as a post-processing device to process sheets one by one and conveyance rollers 1 and 2 are provided. The conveyance path A is a common path for sheets conveyed to the conveyance paths B, C, or D.

The sheet is sent to the conveyance path B, C, or D by first and second separation pawls 15 and 16. The conveyance path B leads to an upper tray 201, and the conveyance path C leads to a shift tray 202. The conveyance path D leads to a processing tray F (hereinafter also "side-stapling tray F") on which the sheets are aligned and stapled.

The sheet processing apparatus PD can perform punching (with the punch unit 100), alignment and side stapling (with a trailing-end fence 51, jogger fences 53, and a side stapler S1), alignment and center stapling (with a center-folding tray G including upper and lower jogger fences 250*a* and 250*b*, and a center stapler S2), sorting (with the shift tray 202), and center folding (with a folding plate 74 and folding rollers 81). Therefore, the conveyance path A and one of the conveyance paths B, C, and D leading from the conveyance path A are selected. Additionally, the conveyance path D includes a stack portion E. The side-stapling tray F, the center-folding tray G, and the discharge path H are provided downstream from the conveyance path D.

The sheet processing apparatus PD further includes an entry detector 301 provided along the conveyance path A for detecting the sheet received from the image forming apparatus PR. A pair of entrance rollers 1, the punch unit 100, a punch chad container 101, a pair of conveyance rollers 2, and the first and second separation pawls 15 and 16 are provided downstream from the entry detector 301 in that order in the direction in which the sheet is transported (hereinafter "sheet conveyance direction"). The first and second separation pawls 15 and 16 are respectively retained at the positions shown in FIG. 1 (initial states) and driven by turning on first and second solenoids. The combination of routes bifurcated by the separations pawls 15 and 16 can be changed by selecting on-off state of the respective solenoids, thereby guiding the sheet to the conveyance path B, C, or D.

To guide the sheet to the conveyance path B, the first solenoid is kept off, and the first separation pawl 15 is at a lower position in the initial state as shown in FIG. 1. Thus, the sheet is transported by the conveyance rollers 3 and the discharge rollers 4 and discharged to the upper tray 201.

To guide the sheet to the conveyance path C, the first and second solenoids are turned on from the state shown in FIG. 1. In the initial state, the second separation pawl 16 is at an upper position, and the first and second separations pawls 15 and 16 pivot up and down, respectively, when the first and second solenoids are thus turned on. Thus, the sheet is transported by conveyance rollers 5 and a pair of discharge rollers 6 (6*a* and 6*b*) to the shift tray 202. In this case, sheets are sorted. The pair of discharge rollers 6, a return roller 13, a sheet level detector 330, the shift tray 202, a shifting unit to reciprocate the shift tray 202 in a direction perpendicular to the sheet conveyance direction, and an elevation unit to move up or down the shift tray 202 together form a mechanism for sorting sheets.

To guide the sheet to the conveyance path D, the first solenoid to drive the first separation pawl 15 is turned on, and the second solenoid to drive the second separation pawl 16 is turned off. Thus, the first and second separation pawls 15 and 16 are rotated up, and the sheet is transported by the conveyance rollers 2 and further by conveyance rollers 7 to the conveyance path D. Then, the sheet is transported along the conveyance path D to the side-stapling tray F, where the sheets are aligned, or aligned and stapled, after which a sheet guide 44 forwards the sheets to the conveyance path C leading to the shift tray 202 or the center-folding tray G that performs folding of sheets and the like. When the sheet is directed to the shift tray 202, the pair of discharge rollers 6 discharges the sheet thereto. The sheets guided to the center-folding tray G are folded in two and stapled along its centerline, after which the sheets are transported through the discharge path H and discharged by discharge rollers 83 to a lower tray 203.

By contrast, a separation pawl 17 is provided in the conveyance path D and retained at a position shown in FIG. 1 by a low-load spring. After a trailing edge of the sheet passes by the separation pawl 17, at least one of pairs of conveyance rollers 9 and 10, and a pair of discharge rollers 11 is rotated in reverse, thereby reversing the sheet along a guide roller 8. Thus, the sheet is transported to the stack portion E with the trailing edge forming the front end of the sheet. The sheet is retained in the stack portion E so that subsequent sheets can be stacked thereon sequentially by repeating this operation. Then, multiple sheets can be transported from the stack portion E at a time. It is to be noted that reference numeral 304 represents a pre-stack detector for determining the timing of reverse transport of the sheet when the sheet is stacked in the stack portion E.

For alignment of sheets and side stapling, the multiple sheets are conveyed from the conveyance path D to the side-stapling tray F and stacked one on another thereon sequentially. In this case, an alignment roller 12 and the trailing-end fence 51 align the sheets one by one longitudinally, that is, in the sheet conveyance direction, and the pair of jogger fences 53 pushes the sheets from both lateral sides to align the sheets in the transverse direction or sheet width direction, perpendicular to the sheet conveyance direction. It is to be noted that the each of the jogger fence 53 includes a planar bottom portion 53-1 (shown in FIG. 4) for supporting the lateral side portion of the bundle from the bottom side (back side) of the bundle.

A controller (CPU 111 shown in FIG. 15) drives the side stapler S1 with a stapling signal to staple the bundle of sheets in intervals between printing jobs, that is, after the last sheet in a job is stacked on the side-stapling tray F and before the initial sheet of a subsequent job is transported thereto. Immediately after stapling, a release belt 52 provided with a release pawl 52*a* forwards the bundle of sheets to the discharge rollers 6, and then the bundle is discharged to the shift tray 202 that is at an upper position to receive the bundle.

Figure 2:
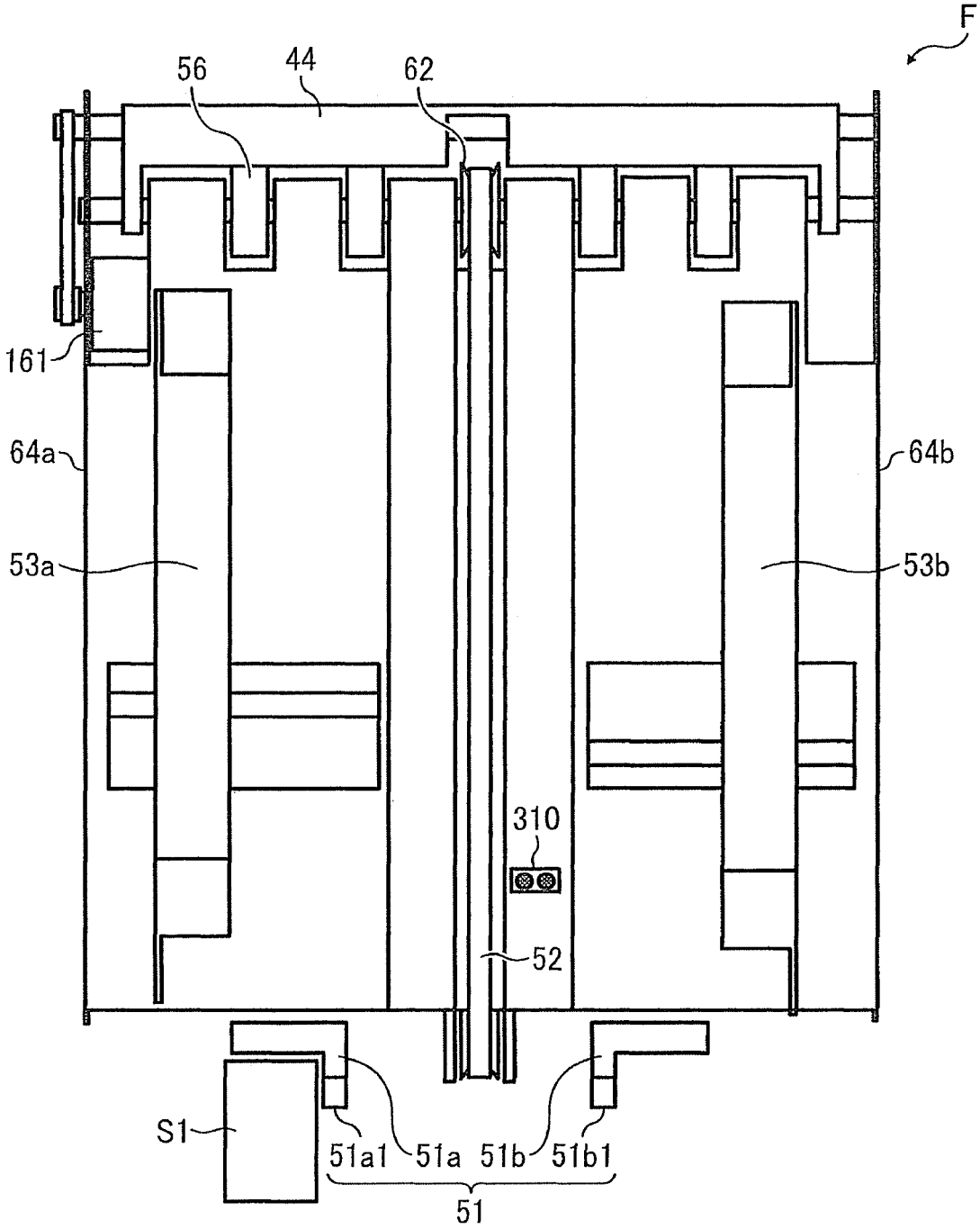
FIG. 2 is schematic view that illustrates a side of a side-stapling tray on which sheets are stacked shown in FIG. 1.
Figure 4:
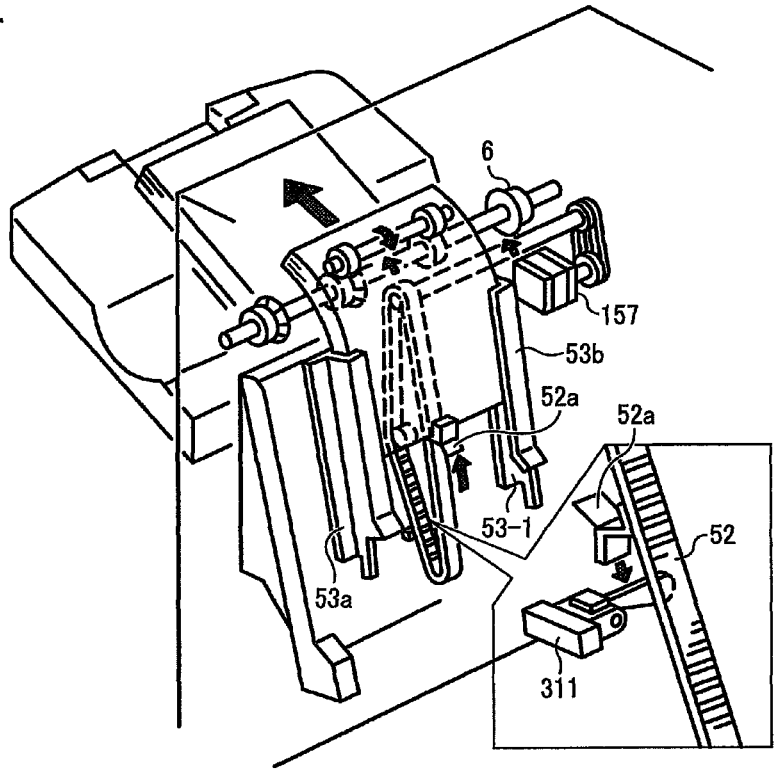
FIG. 4 is a perspective view illustrating, from a side, a release belt shown in FIG. 1.

As shown in FIGS. 2 and 4, the release belt 52 is positioned at a center of alignment in the sheet width direction, stretched around pulleys 62, and a release belt drive motor 157 (shown in FIG. 4) drives the release belt 52. Additionally, multiple release rollers 56 are provided symmetrically relative to the release belt 52. The release rollers 56 are rotatable about a driving shaft and serve as driven rollers.

A belt home position (HP) detector 311 detects whether the release pawls 52*a* and 52*a*' are at home positions. The belt HP detector 311 is turned on and off by the release pawl 52*a* provided at the release belt 52. The two release pawls 52*a* (52*a* and 52*a*') are provided on an outer circumferential surface of the release belt 52 at positions facing each other. The release pawls 52*a* and 52*a*' transport the bundle stacked on the side-stapling tray F alternately. Additionally, the release belt 52 may be rotated in reverse as required so that the leading side of the sheets can be aligned on the back of the release pawl 52*a*' facing the release pawl 52*a* on standby, waiting for the bundle.

It is to be noted that reference numeral 110 shown in FIG. 1 represents a trailing-end holding lever positioned at a lower end of the trailing-end fence 51 to hold the trailing end of the bundle of sheets. The trailing-end holding lever 110 reciprocates substantially perpendicular to the side-stapling tray F. Although the sheets discharged to the side-stapling tray F are aligned one by one by the alignment roller 12 in the sheet conveyance direction, the trailing end thereof tends to bulge under its own weight if the trailing end of the sheet curls or the rigidity thereof is relatively low. Further, as the number of sheets stacked increases, the space to accommodate subsequent sheets inside the trailing-end fence 51 decreases, thus degrading alignment performance. In view of the foregoing, a mechanism to hold the trailing end of sheets is provided to reduce bulging of the trailing end of the sheets, thus facilitating introduction of subsequent sheets inside the trailing-end fence 51. The mechanism includes the trailing-end holding lever 110 that directly holds the trailing end of sheets.

It is to be noted that, in FIG. 1, reference numerals 302, 303, 304, 305 and 310 represent sheet detectors to detect passage of sheets or presence of sheets stacked at respective positions.

FIG. 2 is a schematic view that illustrates a side of the side-stapling tray F on which sheets are stacked as viewed from the right in FIG. 1.

In FIG. 2, the sheet transported form the image forming apparatus PR on the upstream side is aligned by the jogger fences 53 (53*a* and 53*b*) in the sheet width direction. Further, the trailing-end fence 51 aligns the sheet in the sheet conveyance direction. The trailing-end fence 51 includes right and left parts 51*a* and 51*b* (hereinafter "right and left trailing-end fences 51*a* and 51*b*"). The right and left trailing-end fences 51*a* and 51*b* respectively include stack portions 51*a*1 and 51*b*1 as well as back supporters 51*a*3 and 51*b*3 (shown in FIG. 6) perpendicular to the stack portions 51*a*1 and 51*b*1 and in parallel to the surface of the bundle of sheets stacked in the side-stapling tray F. A trailing edge ST (shown in FIG. 3) of the bundle of sheets contacts inner sides of the stack portions 51*a*1 and 51*b*1 and thus is supported at two positions by the stack portions 51*a*1 and 51*b*1. After the bundle of sheets is aligned, the side stapler S1 staples the end portion of the bundle, and the release belt 52 is driven by the release belt drive motor 157 counterclockwise in FIG. 4, which is a perspective view illustrating movement of the release belt 52. Accordingly, the stapled bundle is lifted to a predetermined or given position by the right and left trailing-end fences 51*a* and 51*b*, scooped by the release pawls 52*a* provided on the release belt 52, and then discharged from the side-stapling tray F. It is to be noted that reference characters 64*a* and 64*b* represent a front plate and a back plate of the apparatus. Additionally, the above-described operation can be also performed for a bundle of sheets that is aligned but is not stapled.

Figure 3A:
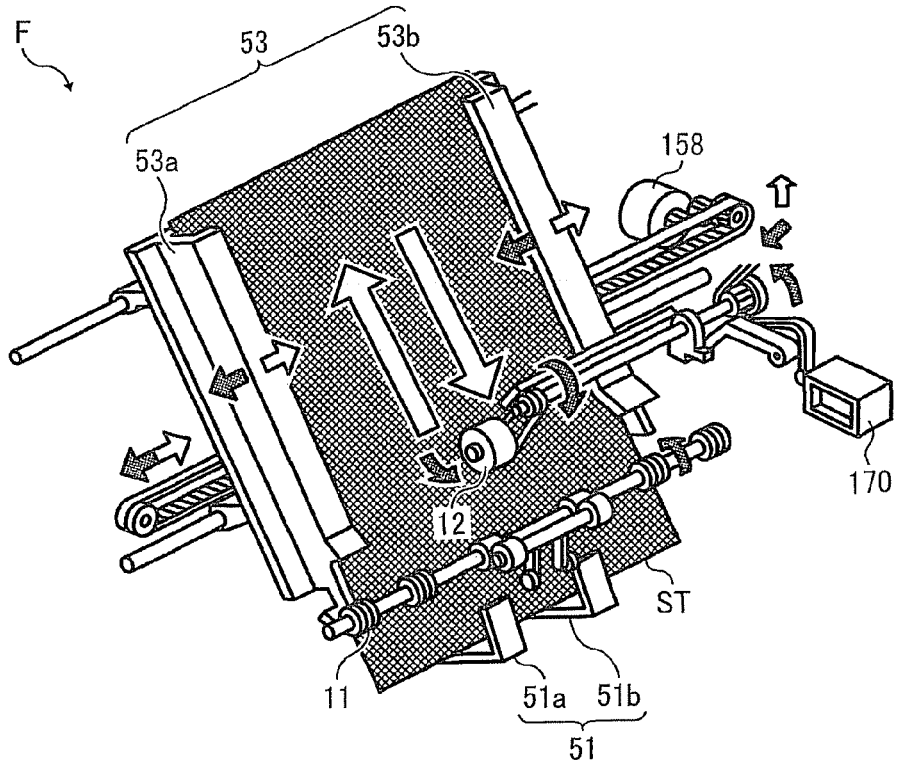
FIG. 3A is a perspective view that schematically illustrates the side-stapling tray and related portions.
Figure 3B:
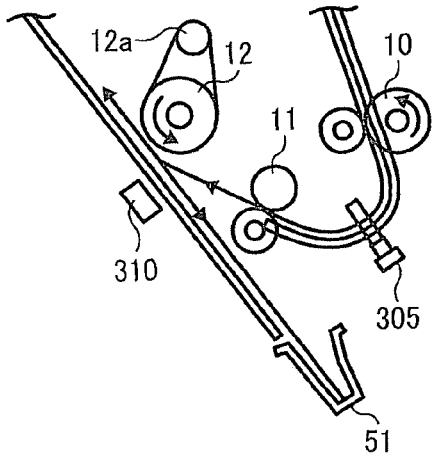
FIG. 3B is a schematic cross-sectional view of the side-stapling tray and related portions.

FIG. 3 is a perspective view that schematically illustrates the side-stapling tray F and related portions.

As shown in FIG. 3, the sheets guided by the discharge rollers 11 are staked one on another on the side-stapling tray F. When the number of sheets discharged to the side-stapling tray F is only one, for each sheet, longitudinal alignment is performed between the alignment roller 12 and the trailing-end fence 51, that is, in the sheet conveyance direction, and transverse alignment is performed by the pair of jogger fences 53 (53*a* and 53*b*) that pushes the sheets from both sides in direction perpendicular to the sheet conveyance direction. The alignment roller 12 is caused to swing on a support point 12*a* by a solenoid 170 (shown in FIG. 3A). Accordingly, the alignment roller 12 intermittently pushes the sheet placed on the side-stapling tray F, thereby causing the trailing edge ST of the sheet to constant the trailing-end fence 51. It is to be noted that the alignment roller 12 itself rotates counterclockwise in the drawing. As shown in FIGS. 2 and 3, the jogger fences 53 (53*a* and 53*b*) are respectively provided on the front side and the back side of the sheet processing apparatus PD. A jogger motor 158 capable of rotating in both normal and reverse directions drives the pair of jogger fences 53 via a timing belt, and thus the jogger fences 53 move reciprocally and symmetrically in the sheet width direction.

Figure 5:
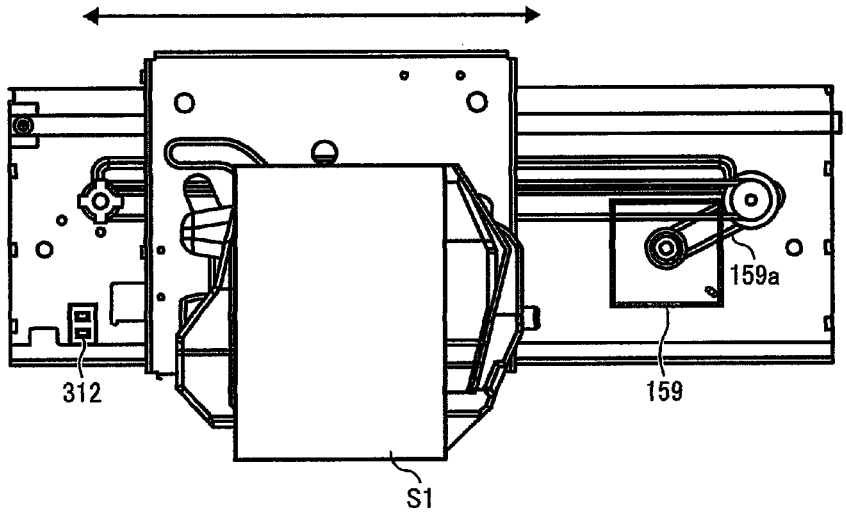
FIG. 5 is a perspective view illustrating a shifting mechanism to move a stapler.

FIG. 5 is a side view of a stapler shifting mechanism and illustrates a front view of the stapler.

As shown in FIG. 5, a stapler motor 159 capable of rotating in both normal and reverse directions drives the side stapler S1 via a timing belt 159*a*, and thus the side stapler S1 moves in the sheet width direction to staple a predetermined or given position in an end portion of the sheets in the sheet conveyance direction. A stapler HP detector 312 is provided in an end portion of the movable range of the side stapler S1 to detect whether the side stapler S1 is at its home position. The position in the sheet width direction stapled by the side stapler S1 is determined by the amount by which the side stapler S1 moves from the home position. The side stapler S1 is designed to staple sheets either at a single position or multiple positions (typically, two positions). The side stapler S1 can move at least the entire length of the sheet supported by the right and left trailing-end fences 51*a* and 51*b* in the width direction. Additionally, the side stapler S1 can move fully to the front side of the sheet processing apparatus PD for replacement of staples, thus facilitating replacement work of users.

Returning now to FIG. 1, a sheet guide mechanism to change the conveyance direction of the bundle s provided downstream from the side-stapling tray F in the sheet conveyance direction. A conveyance unit 35 to transport the bundle of sheets, the release rollers 56 to turn the bundle, and the sheet guide 44 to guide the bundle when the bundle is turned together form the sheet guide mechanism to transport the bundle from the side-stapling tray F to the center-folding tray G or from the side-stapling tray F to the shift tray 202.

The conveyance unit 35 includes a roller 36 to which driving force is transmitted from a driving shaft 37 via a timing belt. The roller 36 and the driving shaft 37 are connected and supported by an arm, and the roller 36 can swing about the driving shaft 37. The roller 36 of the conveyance unit 35 is caused to swing by a cam 40 that rotates about a rotary shaft, driven by a motor. The conveyance unit 35 further includes a driven roller 42 positioned facing the roller 36. The conveyance unit 35 presses the bundle of sheets interposed between the driven roller 42 and the roller 36 with an elastic member, thereby applying a transport force thereto.

A conveyance path along which the bundle of sheets is turned (hereinafter also "a turning path") from the side-stapling tray F to the center-folding tray G is formed between the release roller 56 and an inner side of the sheet guide 44 facing the release roller 56. The sheet guide 44 can rotate around a fulcrum, driven by a driving motor 161 (shown in FIG. 2). To transport the bundle of sheets from the side-stapling tray F to the shift tray 202, the sheet guide 44 rotates around the fulcrum clockwise in FIG. 1, and a conveyance path is formed between an outer surface of the sheet guide 44 (opposite the release roller 56) and a planar guide provided outside the sheet guide 44. To forward the bundle of sheets from the side-stapling tray F to the center-folding tray G, the release pawls 52*a* lifts the trailing end of the bundle of sheets aligned on the side-stapling tray F. Then, the bundle is transported, being sandwiched between the roller 36 of the conveyance unit 35 and the driven roller 42 facing it. At that time, the roller 36 of the conveyance unit 35 waits for the bundle at a position not to contact the leading edge of the bundle. After the leading edge of the bundle passes by the roller 36, the roller 36 is brought into contact with a surface of the bundle, and then the roller 36 transports the bundle. At that time, the sheet guide 44 and the release roller 56 guide the bundle transported through the turning path downstream to the center-folding tray G.

As shown in FIG. 2, the center-folding tray G is positioned downstream from the sheet guide mechanism including the conveyance unit 35, the sheet guide 44, and the release roller 56. The center-folding tray G is positioned substantially vertically in FIG. 1, and a center-folding mechanism is provided in a center portion of the center-folding tray G. Additionally, an upper bundle guide 92 and a lower bundle guide 91 are provided above and beneath the center-folding mechanism, respectively.

Additionally, a pair of upper bundle conveyance rollers 71 and a pair of lower bundle conveyance rollers 72 are provided at an upper position and a lower position, respectively, of the upper bundle guide 92, and the upper jogger fences 250*a* are provided on both sides along a side face of the upper bundle guide 92, astriding both the upper bundle conveyance rollers 71 and the lower bundle conveyance rollers 72. Similarly, the lower jogger fences 250*b* extending along a side of the lower bundle guide 91 is provided on either side thereof. The center stapler S2 is provided at the same position as the lower jogger fences 250*b*. The upper jogger fences 250*a* and the lower jogger fences 250*b* align the sheets in the sheet width direction perpendicular to the sheet conveyance direction, driven by a driving unit (not shown). The center stapler S2 includes multiple sets (two sets in the present embodiments) of a clincher unit and a driving unit arranged at a predetermined interval in the sheet width direction.

The sheet processing apparatus PD further includes a movable back fence 73 extending across the lower bundle guide 91. The movable back fence 73 can be moved by a driving unit via a timing belt in the sheet conveyance direction, which is vertical in FIG. 1. As shown in FIG. 1, the driving unit to move the movable back fence 73 includes a driving pulley around which the timing belt is wound, a driven pulley, and a stepping motor to drive the driving pulley. Similarly, an aligning pawl 251 and a driving unit to drive it are provided on the side of an upper end of the upper bundle guide 92. The driving unit moves the aligning pawl 251 via a timing belt 252 reciprocally in a direction away from the bundle guide unit including the lower and upper bundle guides 91 and 92 and the opposite direction to push the trailing end of the bundle (positioned on the upstream side when the bundle is introduced to the bundle guide unit).

The center-folding mechanism is positioned at a substantially center of the center-folding tray G and includes the folding plate 74, the pair of folding rollers 81, and the conveyance path H through which a bundle of folded sheets is transported. It is to be noted that, in FIG. 1, reference numeral 321 denotes a sheet detector to detect that the bundle is positioned at a position where center folding is performed, 322 denotes a fence HP detector to detect whether the movable back fence 73 is at the home position, 323 denotes a folded-portion detector to detect passage of the bundle of folded sheets, and 326 denotes a pawl HP detector to detect whether the aligning pawl 251 is at the home position.

Additionally, in the present embodiment, a detection lever 501 is provided adjacent to and above the lower tray 203 to detect the height of the bundle of sheets folded along the centerline, stacked on the lower tray 203. The detection lever 501 is pivotably supported by a fulcrum 501*a*. Further, a sheet level detector 505 detects the angle of the detection lever 501 to control ascent and descent of the lower tray 203 and to detect overflow of sheets.

Specific features of the present embodiment is that the position of the trailing-end fence (reference fence) 51 is calculated in accordance with the relation between sheet size and stapled positions, and that the trailing-end fence 51 is preferably moved to the position thus calculated before stapling processing is started. According to the present embodiment, the sheet processing apparatus PD can staple given lateral positions in the trailing end portion of a bundle of sheets in the sheet conveyance direction.

Figure 6:
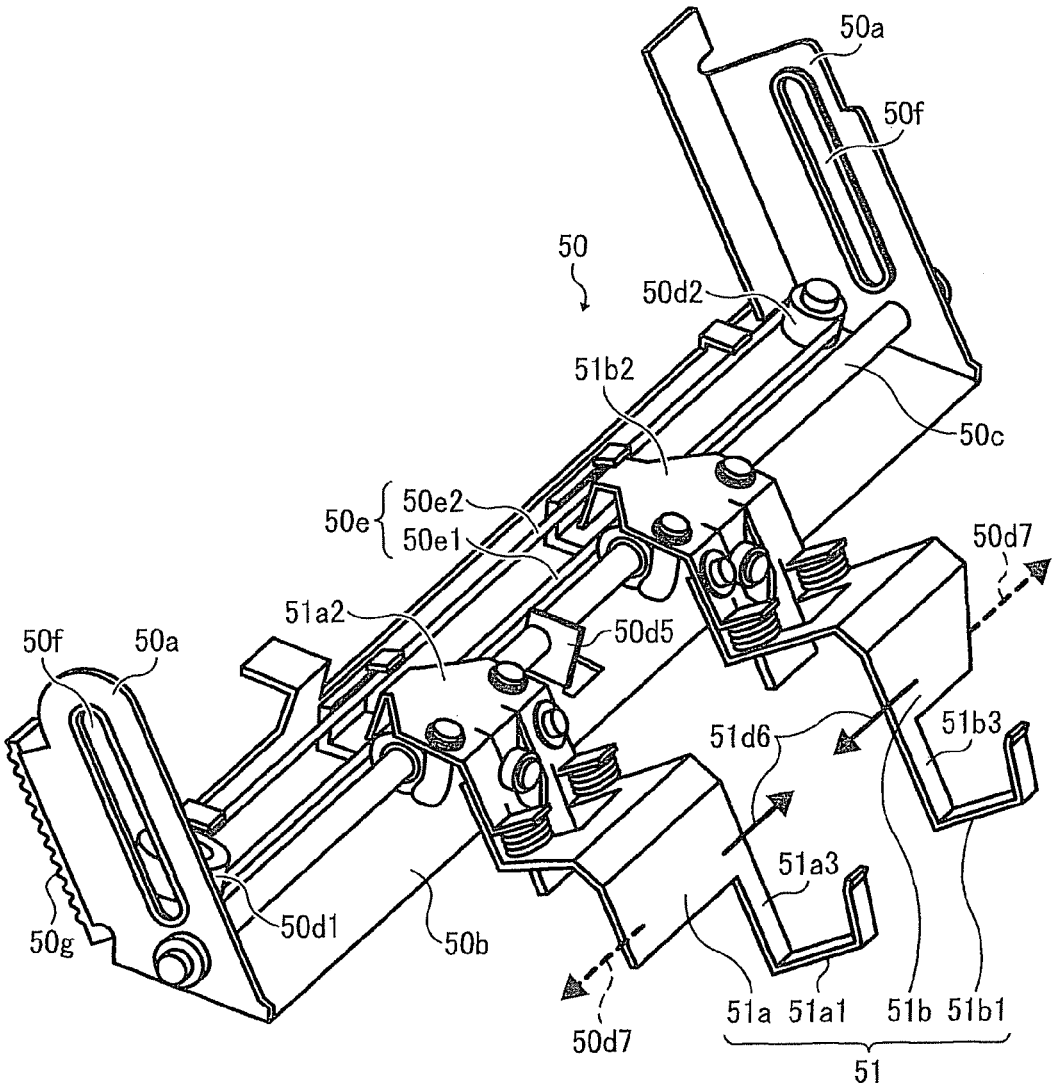
FIG. 6 is a perspective view illustrating a transverse shifting mechanism to move a pair of trailing-end fences in the direction perpendicular to a sheet conveyance direction.
Figure 7:
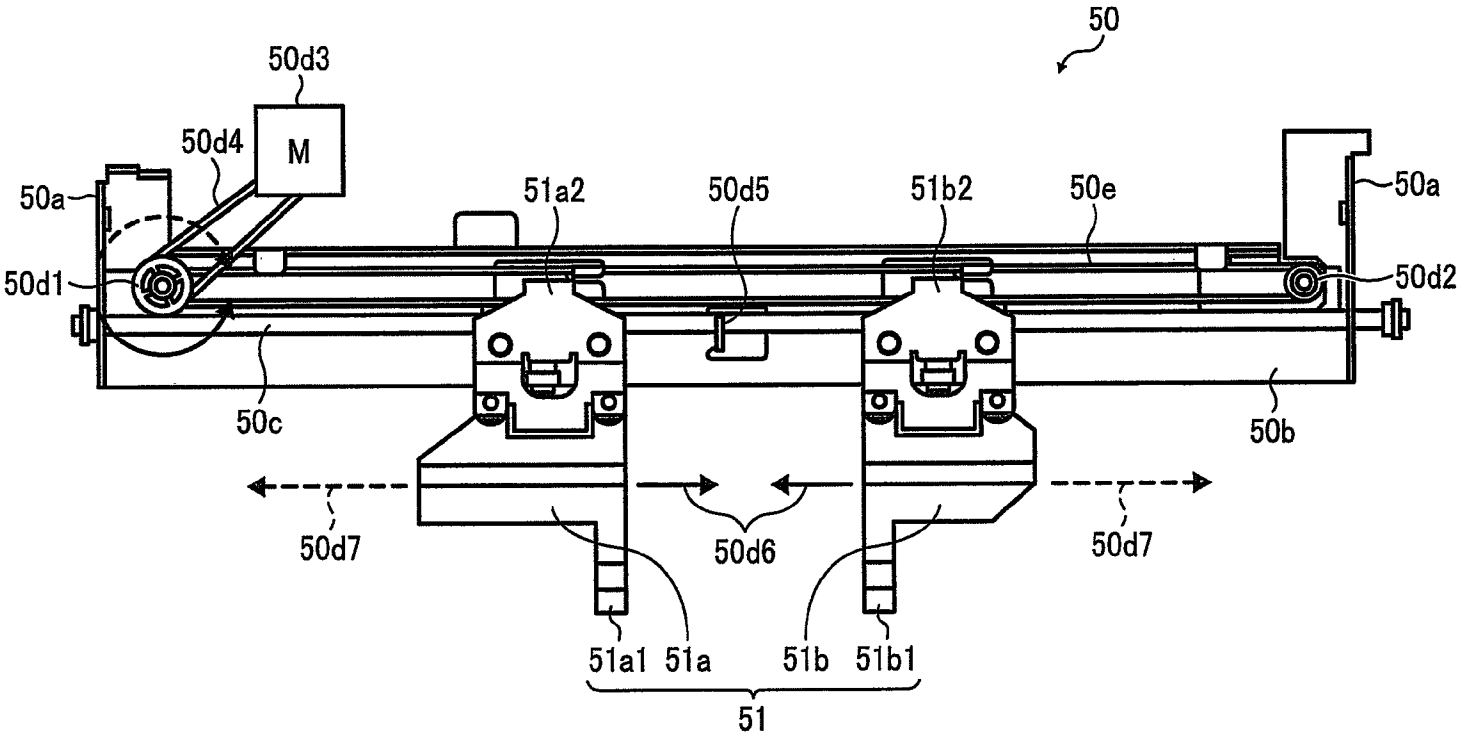
FIG. 7 is a side view of the transverse shifting mechanism.
Figure 8A:
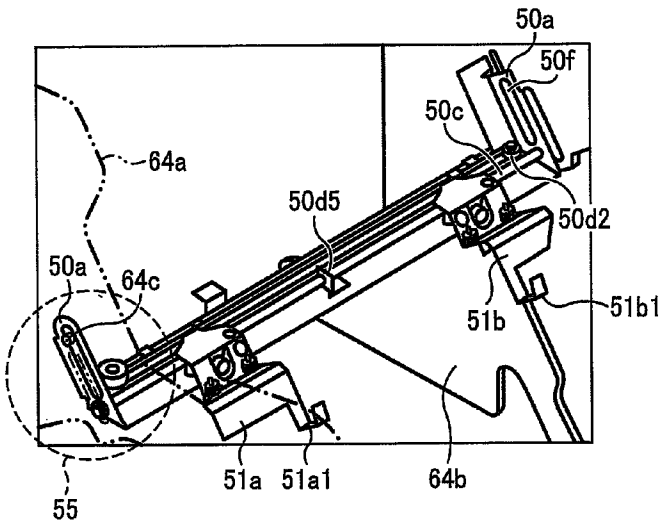
FIGS. 8A, 8B, and 8C illustrate a configuration and operation of a longitudinal shifting mechanism to move the pair of trailing-end fences in the sheet conveyance direction.
Figure 8B:
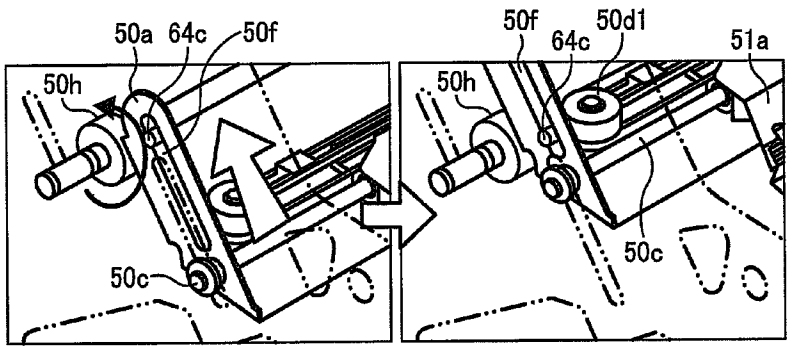
Figure 8C:
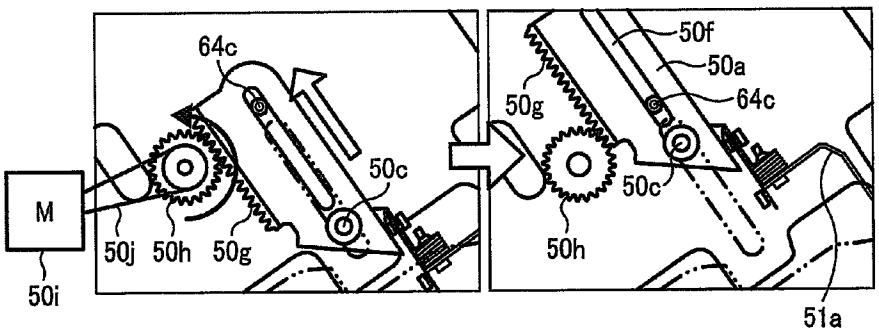

FIG. 6 is a perspective view illustrating a shifting mechanism 50 to move the trailing-end fence 51 in the direction perpendicular to the sheet conveyance direction (hereinafter "transverse shifting mechanism 50"), and FIG. 7 is a side view of the transverse shifting mechanism 50. FIGS. 8A, 8B, and 8C illustrate a configuration and operation of a shifting mechanism 55 to move the trailing-end fence 51 in the sheet conveyance direction (hereinafter "longitudinal shifting mechanism 55").

In the configuration shown in these drawings, the transverse shifting mechanism 50 for the trailing-end fence 51 includes a base 50*b*, a slide shaft 50*c*, a timing belts 50*e* including a pair of parallel extending portions 50*e*1 and 50*e*2, and a fence driving motor 50*d*3. Additionally, the right and left trailing-end fences 51*a* and 51*b* respectively include support portions 51*a*2 and 51*b*2 supported by the transverse shifting mechanism 50. Side plates 50*a* are provided on either side of the base 50*b*. The slide shaft 50*c* extends between the pair of side plates 50*a*, fixed thereto, and slidably supports the support portions 51*a*2 and 51*b*2 of the right and left trailing-end fences 51*a* and 51*b*. The parallel extending portions 50*e*1 and 50*e*2 of the timing belt 50*e* are positioned in parallel to the slide shaft 50*c* and are stretched between timing pulleys 50*d*1 and 50*d*2. Further, a timing belt 50*d*4 (shown in FIG. 7) is provided on the driving side. As the fence driving motor 50*d*3 drives the timing pulley 50*d*1 on the driving side via the timing belt 50*d*4, the timing belt 50*e* rotates.

In the transverse shifting mechanism 50, the support portion 51*a*2 of the right trailing-end fence 51*a* is attached to the parallel extending portion 50*e*1 of the timing belt 50*e*, and the support portion 51*b*2 of the left trailing-end fence 51*b* is attached to the other parallel extending portion 50*e*2. The right and left trailing-end fences 51*a* and 51*b* are symmetrical relative to a support member 50*d*5 positioned in a center portion in the sheet width direction. With this configuration, when the timing belt 50*e* rotates, for example, leftward in FIGS. 6 and 7, the right and left trailing-end fences 51*a* and 51*b* approach each other symmetrically relative to the support member 50*d*5 positioned in the center portion in the sheet width direction as indicated by arrows 50*d*6. By contrast, when the timing belt 50*e* rotates rightward in FIGS. 6 and 7, the right and left trailing-end fences 51*a* and 51*b* move away from each other symmetrically as indicated by broken arrows 50*d*7. Thus, the position of the stack portions 51*a*1 and 51*b*1 as well as the distance between them can be adjusted by the amount by which the fence driving motor 50*d*3 rotates. For example, a stepping motor can be used as the fence driving motor 50*d*3 for its simplicity as well as higher accuracy in control.

Referring to FIGS. 8A to 8C, the longitudinal shifting mechanism 55 for the trailing-end fence 51 includes a pair of slide grooves 50*f*, a pair of pins 64*c*, a rack 50*g*, a pinion 50*h*, a driving motor 50*i*, and a timing belt 50*j*. The slide grooves 50*f* are formed in the respective side plates 50*a* standing on both sides of the base 50*b*. The slide grooves 50*f* parallel the bottom plate of the side-stapling tray F. The pins 64*c* respectively stand perpendicularly to a front plate 64*a* and a back plate 64*b* and restrict movement of the side plates 50*a*, blocked by the respective slide grooves 50*f*. Thus, the pins 64*c* allow the side plates 50*a* to move in only the direction parallel to the bottom plate of the side-stapling tray F. This movement is caused by the pinion 50*h*, to which a driving force is transmitted from the driving motor 50*i* via the timing belt 50*j*, and the rack 50*g*, which is provided on one of the side plates 50*a* and engages the pinion 50*h*. In the present embodiment, with the rotation amount of the driving motor 50*i*, the longitudinal position of the trailing-end fence 51 can be set at a given position between an initial position (lowest position) shown in FIG. 8B and a farthest position (highest position) shown in FIG. 8C to which the trailing-end fence 51 is lifted with a maximum driving amount of the driving motor 50*i*. It is to be noted that the bundle of sheets is forwarded to the release pawls 52*a* at the farthest position or while the trailing-end fence 51 is moving to the farthest position. The driving motor 50*i* can be, for example, a stepping motor for its simplicity in control and higher positioning accuracy similarly.

Thus, the fence driving motor 50*d*3 sets the position of the right and left trailing-end fences 51*a* and 51*b* in the sheet width direction, and the driving motor 50*i* sets their positions in the longitudinal direction (sheet conveyance direction). It is to be noted that the position of the trailing-end fence 51 in the sheet width direction varies depending on the sheet size and the staple position in the sheet width direction, and the position of trailing-end fence 51 in the longitudinal direction varies depending on the distance between the stapled positions and the trailing edge ST of the sheet (i.e., a set amount of margin).

The above-described sheet processing apparatus PD is capable of side stapling at a single position and multiple positions as well as center stapling, and features of the present embodiment relate to side stapling at two positions, which are described in further detail below.

Figure 9:
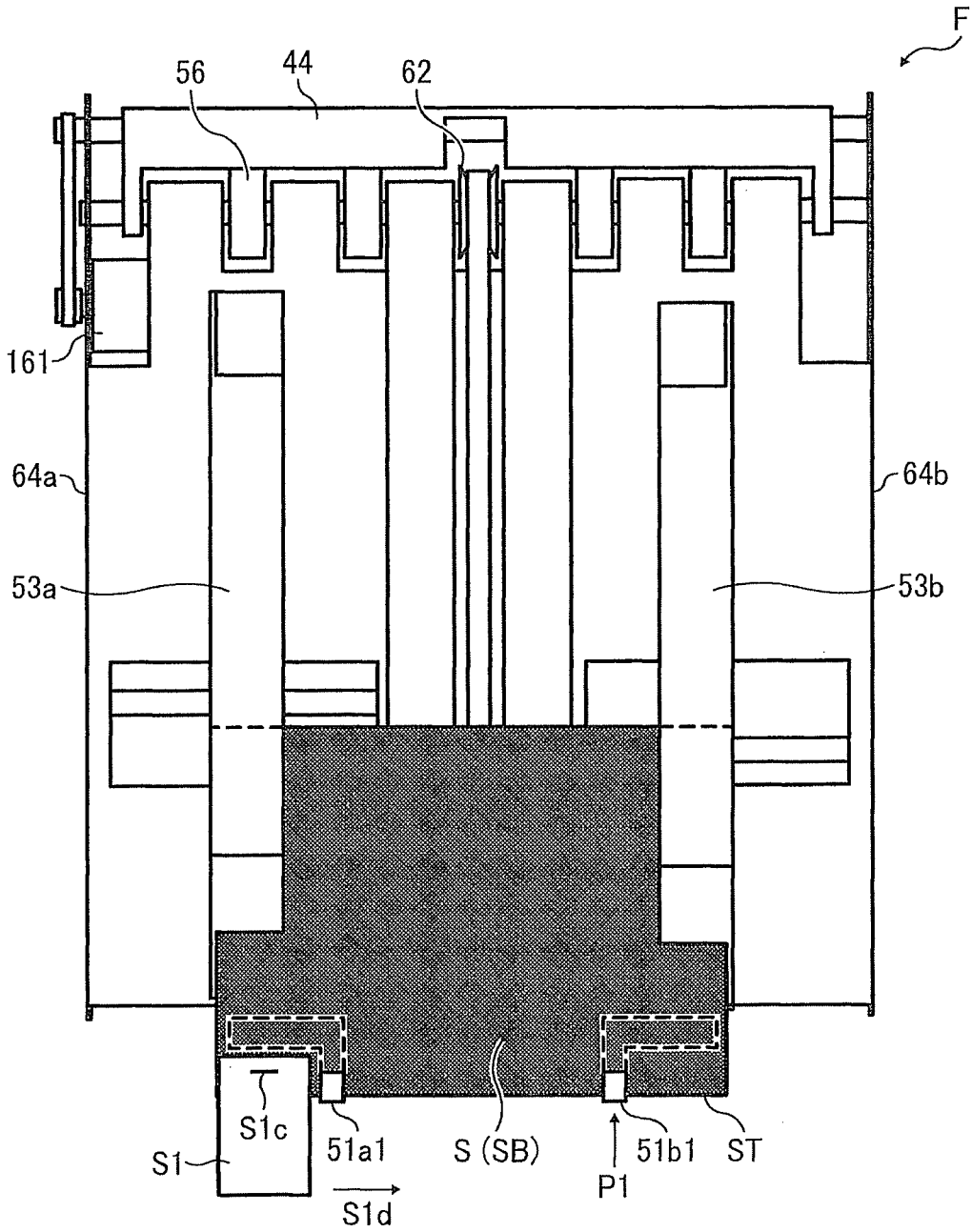
FIG. 9 is a side view of the side-stapling tray in which the pair of trailing-end fences supports a bundle of sheets inside the stapler and an interval between the stack portions is wider.
Figure 10:
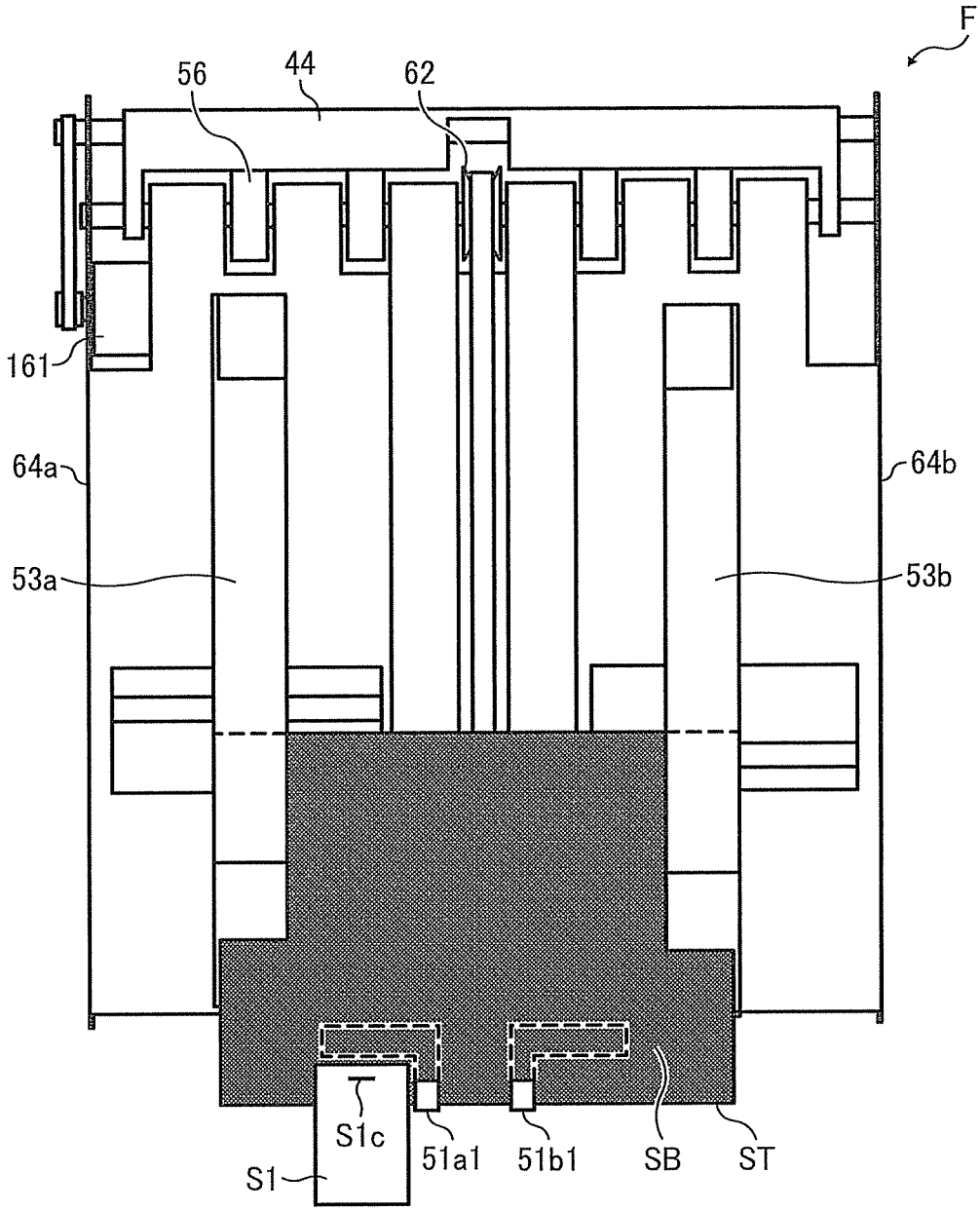
FIG. 10 is a side view of the side-stapling tray in which the pair of trailing-end fences supports the bundle inside the stapler and the interval between the stack portions is narrower.

FIGS. 9 and 10 are plan views of the side-stapling tray F in which the stack portions 51*a*1 and 51*b*1 of the right and left trailing-end fences 51*a* and 51*b* supporting a bundle SB of sheets S are positioned inside the side stapler S1 (closer to the center of the bundle SB).

In FIG. 9, reference character S1*c* represents one of two positions stapled with staples. Because side stapling at two positions is described here, after stapling the bundle SB at the position S1*c*, the side stapler S1 moves to the right in FIG. 9 as indicated by arrow S1*d* to again staple the bundle SB at a position symmetrical or substantially symmetrical to the position S1*c* relative to a center position of the bundle SB in the sheet width direction. Accordingly, the mechanism shown in FIG. 5 causes the side stapler S1 to move laterally in FIG. 9.

As shown in FIG. 1, the side stapler S1 includes the stitcher (driver) S1*a* to discharge staples and drive staples into the bundle and a clincher Sb to bend edges of staples. The stitcher S1*a* and the clincher S1*b* are positioned across a space S1*c* through which the right and left trailing-end fences 51*a* and 51*b* can move. Accordingly, the side stapler S1 can move without interfering with the right and left trailing-end fence 51*a* and 51*b*. Additionally, the stitcher S1*a* and the clincher S1*b* are united together as a single unit differently from the center stapler S2. The stitcher S1*a* does not move in the direction perpendicular to the surface of the bundle SB and serves as a fixed side, whereas the clincher S1*b* moves in the direction perpendicular to the surface of the bundle SB. With this configuration, the bundle SB is stapled while the clincher S1*b* moves toward the stitcher S1*a* at a predetermined stapled position of the bundle SB with the bundle SB in contact with the stack portions 51*a*1 and 51*b*1 of the trailing-end fence 51.

Figure 11:
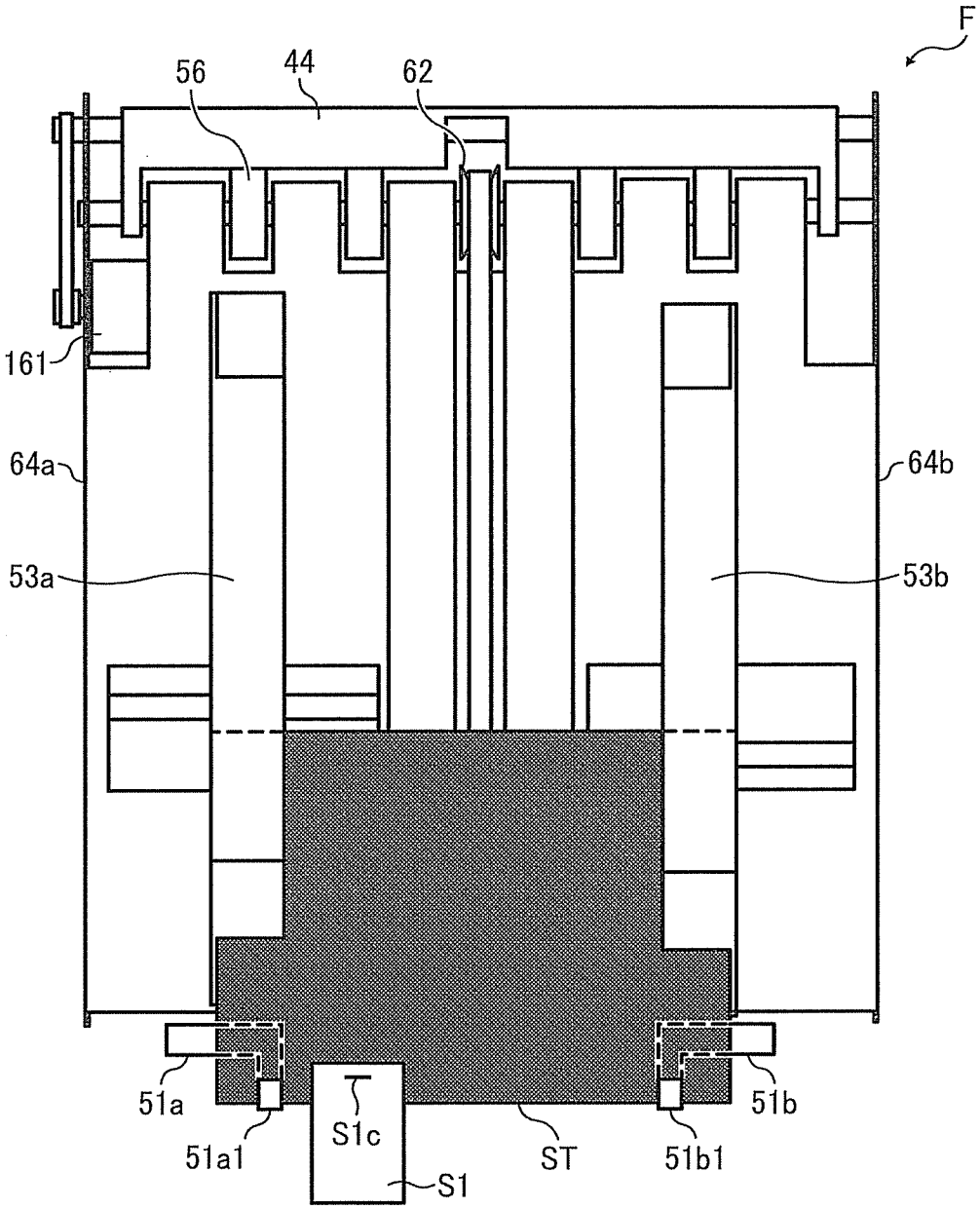
FIG. 11 is a side view of the side-stapling tray in which the pair of trailing-end fences supports the bundle outside the stapler.

Meanwhile, as shown in FIG. 10, the stapled positions may be closer to the center of the stapled side of the bundle SB when the long side of the bundle SB of the same size as that shown in FIG. 9 is stapled at two positions. In this case, the right and left trailing-end fences 51*a* and 51*b* move inside from the position shown in FIG. 9. Accordingly, the stack portions 51*a*1 and 51*b*1 (the right and left trailing-end fences 51*a* and 51*b*) support the bundle SB at positions closer to the center position in the sheet width direction. However, the stack portions 51*a*1 and 51*b*1 are positioned closer to the center of the bundle SB compared with the case shown in FIG. 9 with larger portions of the bundle SB positioned outside the contact positions with the stack portions 51*a*1 and 51*b*1. Accordingly, the bundle SB supported by the stack portions 51*a*1 and 51*b*1 is unbalanced. In such a case, when the right and left trailing-end fences 51*a* and 51*b* are moved outside and support the bundle SB at outer positions (second positions P2) as shown in FIG. 11, the balance of the bundle SB can be secured.

In view of the foregoing, in the present embodiment, the right and left trailing-end fences 51*a* and 51*b* are designed to be set at either at the inner positions (first positions) P1 or the outer positions (second positions) P2. This configuration enables stapling of the bundle SB with the bundle SB supported securely, thus preventing or reducing jamming of sheets or defective stapling.

Figure 12:
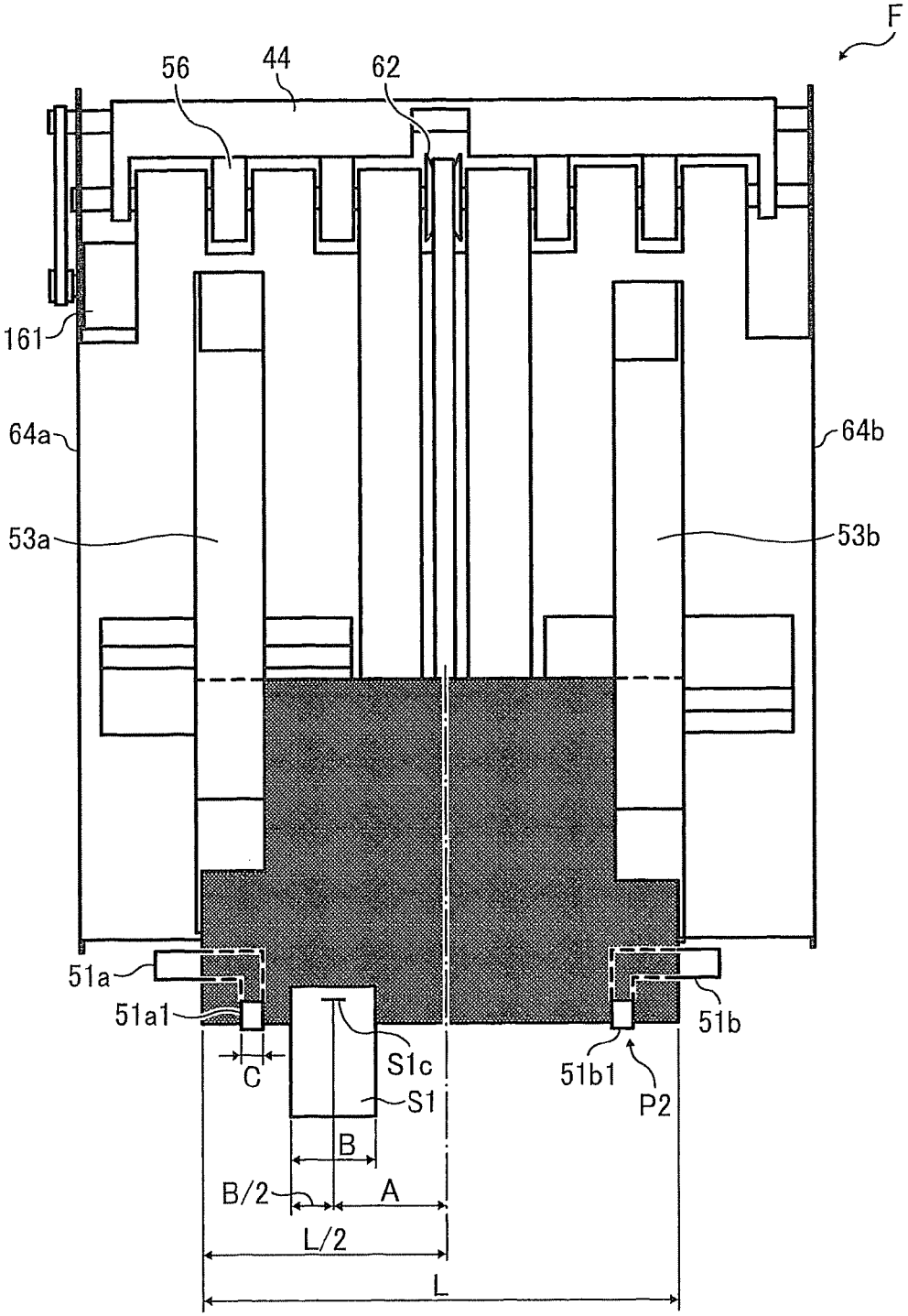
FIG. 12 illustrates multiple stapling-related variables based on which the position of the trailing-end fence is determined.

More specifically, in the present embodiment, either the inner position P1 or the outer position P2 is selected in accordance with the relation between the sheet width and the stapled positions as follows. Referring to FIG. 12, the stack portions 51*a*1 and 51*b*1 of the right and left trailing-end fences 51*a* and 51*b* are set at the inner positions P1 positioned inside the side stapler S1 when the relation among a length L of the stapled side of the bundle SB (length of the trailing side of the sheet ST), a distance A from the center position of the bundle SB to the stapled position S1*c* in the direction along the stapled side, and a length B of the staple in the direction along the stapled side, and a length C of the stack portions 51*a*1 and 51*b*1 in the direction along the stapled side (the width necessary to support the bundle SB) satisfies the following formula.

$$L/2<A+B/2+C \quad (1)$$

By contrast, the stack portions 51*a*1 and 51*b*1 of the right and left trailing-end fences 51*a* and 51*b* are set at the outer positions P2 positioned outside the side stapler S1 in the sheet width direction when the relation among these stapling-related variables satisfies the following formula.

$$L/2\geqq A+B/2+C \quad (2)$$

At that time, it is preferable that the trailing-end fence 51 is set at either the inner positions P1 or the outer positions P2 before the bundle of sheets is aligned. This procedure can eliminate the impact to the bundle and time required to move the trailing-end fence 51 after the bundle is aligned. Therefore, productivity can be improved without degrading the accuracy in sheet alignment.

It is to be noted that the first position P1 and the second position P2 can be preset in accordance with the relation between the length of stapled side (trailing side) of the bundle, which is known from the sheet size, the direction of the sheet, and the stapled positions, and stored in a table in a storage unit of the controller (shown in FIG. 15) of the sheet processing apparatus PD. The position to which the trailing-end fence 51 is moved can be retrieved from the table when the above-described relation is known. Additionally, the width C of the stack portions 51*a*1 and 51*b*1 is a necessary amount for securing the bundle SB and can be set to a preferable amount selected experimentally.

Figure 13:
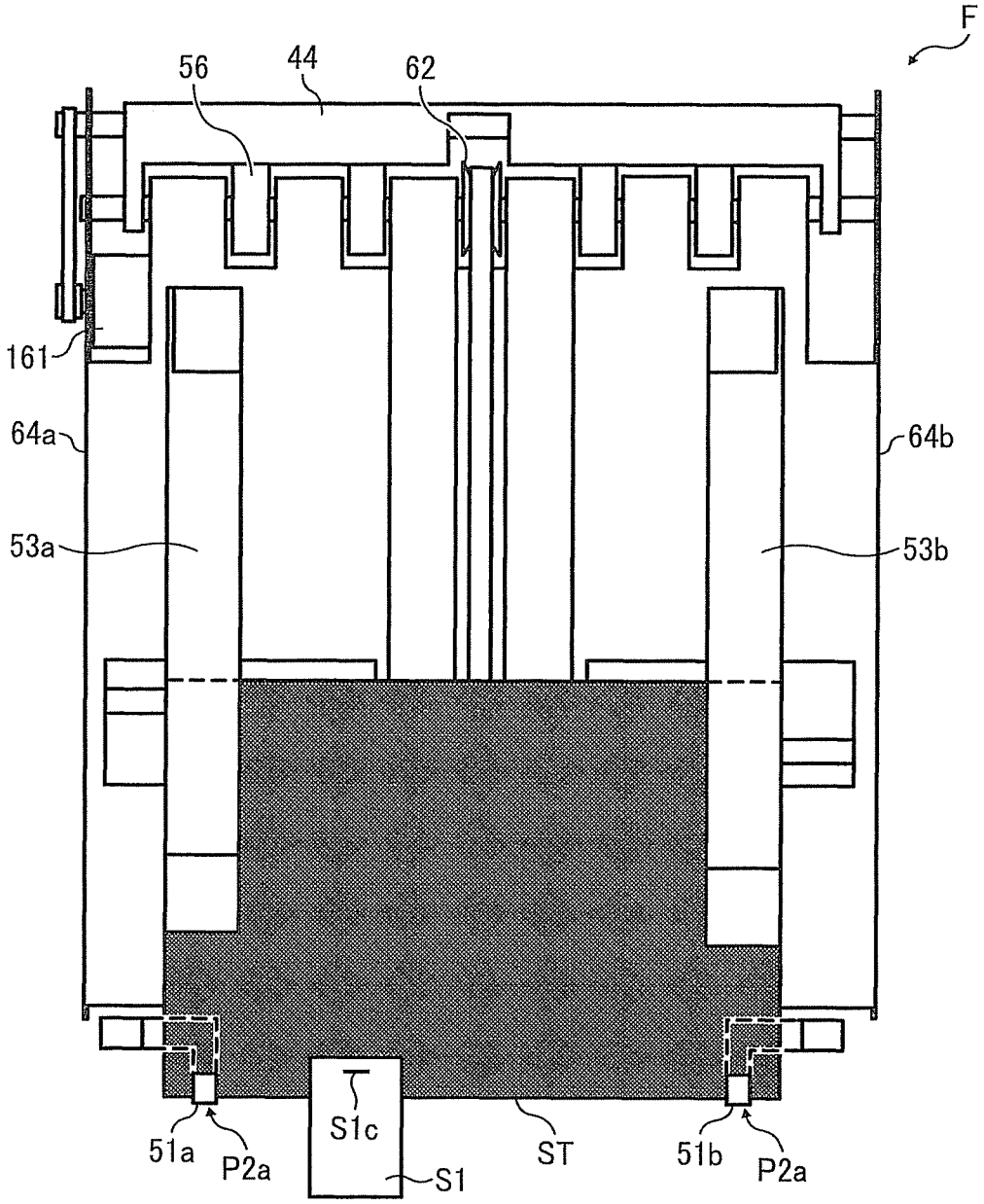
FIG. 13 is a side view of the side-stapling tray in which the pair of trailing-end fences supports the bundle outside the stapler, away from stapled positions.
Figure 14:
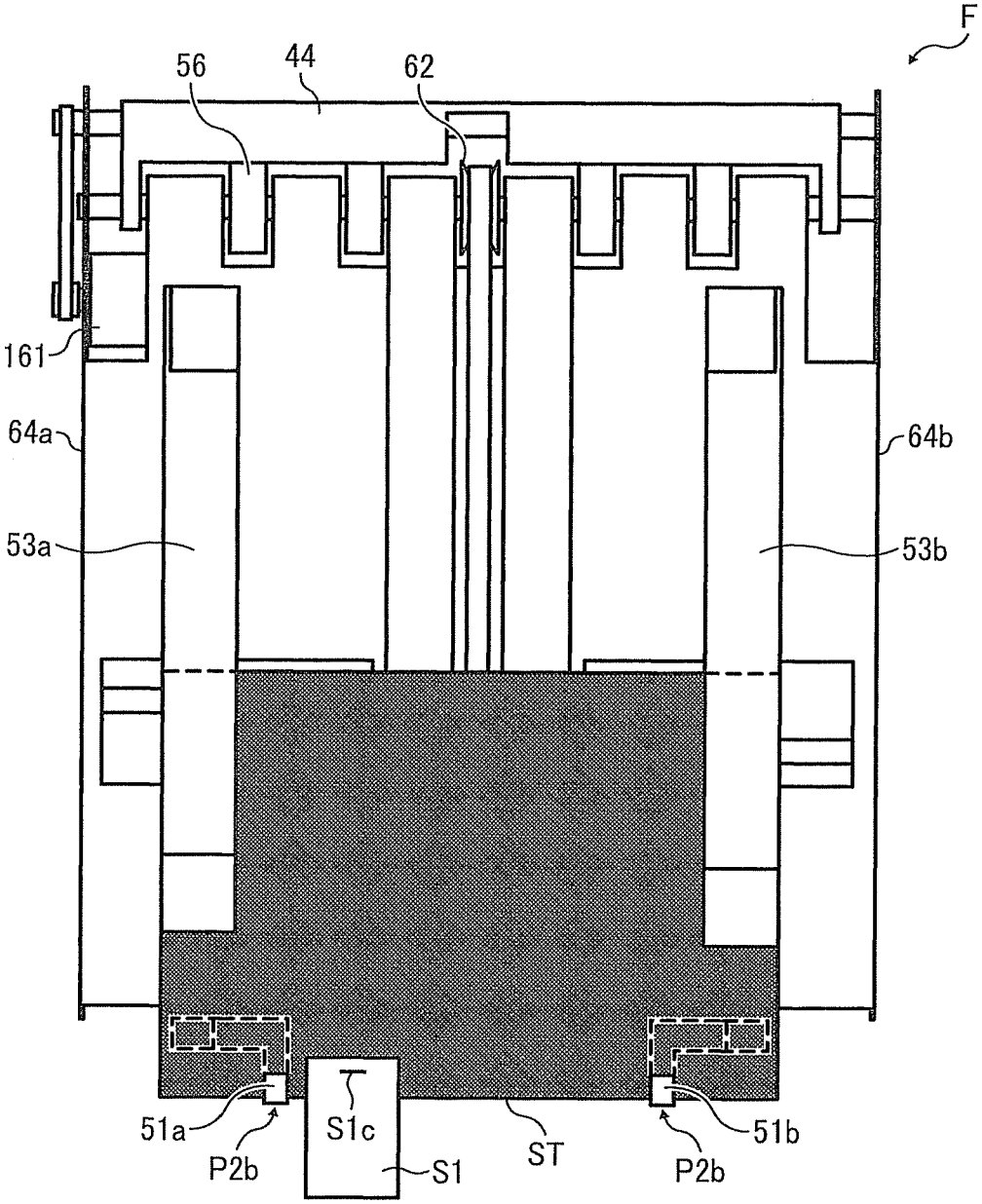
FIG. 14 is a side view of the side-stapling tray in which the pair of trailing-end fences supports the bundle outside the stapler, closer to the stapled positions.

Additionally, as the outer positions (second positions) P2 outside the side stapler S1 in the sheet width direction may be selected from multiple different positions such as positions (third positions) P2*a* shown in FIG. 13 farther from the stapled position S1*c* and positions (fourth positions) P2*b* shown in FIG. 14 closer to the stapled position S1*c*. Thresholds of sheet-relate variables such as sheet size, sheet thickness, sheet type, and the like are predetermined experimentally, and one of the multiple outer positions, for example, either the third positions P2*a* or the fourth positions P2*a* in the present embodiment, is selected according to the thresholds. It is to be noted that the sheet size includes the direction of the sheet (lengthwise or sideways).

Moving and positioning the side stapler S1 are controlled by controlling the stapler motor 159, and moving and positioning the right and left trailing-end fences 51*a* and 51*b* are controlled by controlling the fence driving motor 50*d*3. It is to be noted that, although not described in detail, the driving motor 50*i* sets the distance from the edge of the bundle SB on the stapled side (trailing edge ST), and the stapled positions are set at desired distance from the edge of the bundle SB by controlling the driving motor 50*i*. A central processing unit (CPU) 111 of the sheet processing apparatus PD described below controls driving of those motors.

Figure 15:
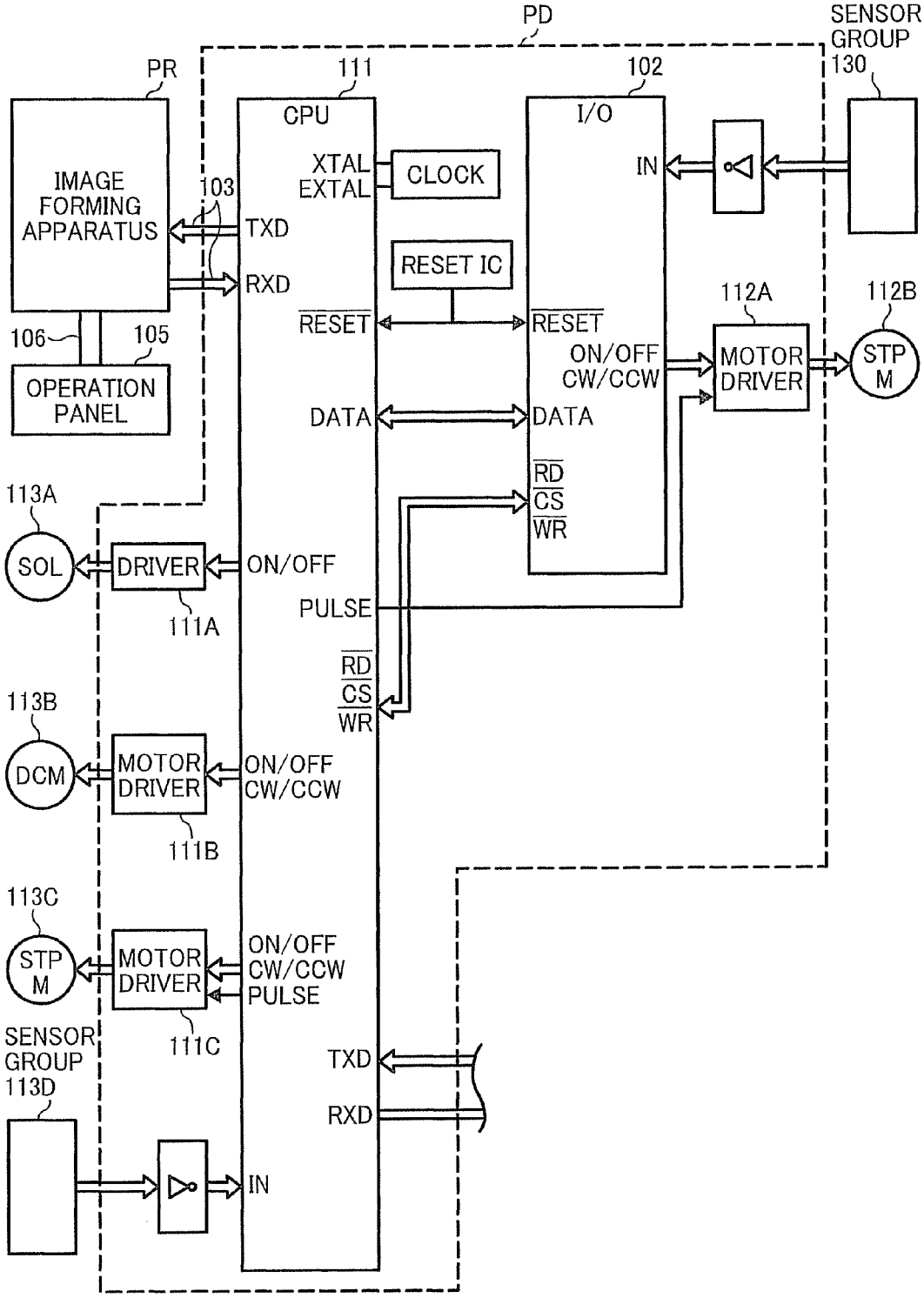
FIG. 15 is a block diagram that schematically illustrates a control configuration of the system including the sheet processing apparatus and the image forming apparatus shown in FIG. 1.

FIG. 15 is a block diagram that schematically illustrates a control configuration of the system including the sheet processing apparatus PD and the image forming apparatus PR.

The system includes a control circuit incorporating a micro computer including the CPU 111 and an input/output (I/O) interface 102. The CPU 111 performs various types of control according to signals input from either a CPU of the image forming apparatus PR or the control panel 105, signals received via the I/O interface 102 from respective switches as well as sensor groups 113D and 130 including various sensors and detectors. The control circuit further includes a pulse width module (PWM) generator 112C. Additionally, the CPU 111 controls a solenoid 113A, a direct current (DC) motor 113B, and stepping motors 112B and 113C via a driver 111A and motor drivers 111C, 111B, and 112A. The CPU 111 acquires data from the detectors in the apparatus via the interface 102. Further, according to what is controlled or sensors, the CPU 111 controls the motors 112B, 113B, and 113C and acquires data from the sensors. The CPU 111 reads out program codes stored in a read only memory (ROM), and performs various types of control based on the programs defined by the program codes using a random access memory (RAM) as a work area and data buffer.

Moreover, the sheet processing apparatus PD may be controlled according to instructions or data transmitted from the CPU of the image forming apparatus PR. The user can input instructions from the control panel 105 of the image forming apparatus PR, and the control panel 105 is communicably connected to the CPU of the image forming apparatus PR via an interface 106. With this configuration, the image forming apparatus PR can transmit operation signals input via the control panel 105 to the sheet processing apparatus PD, and the state or functions of the sheet processing apparatus PD can be reported to the user or operator.

Figure 16:
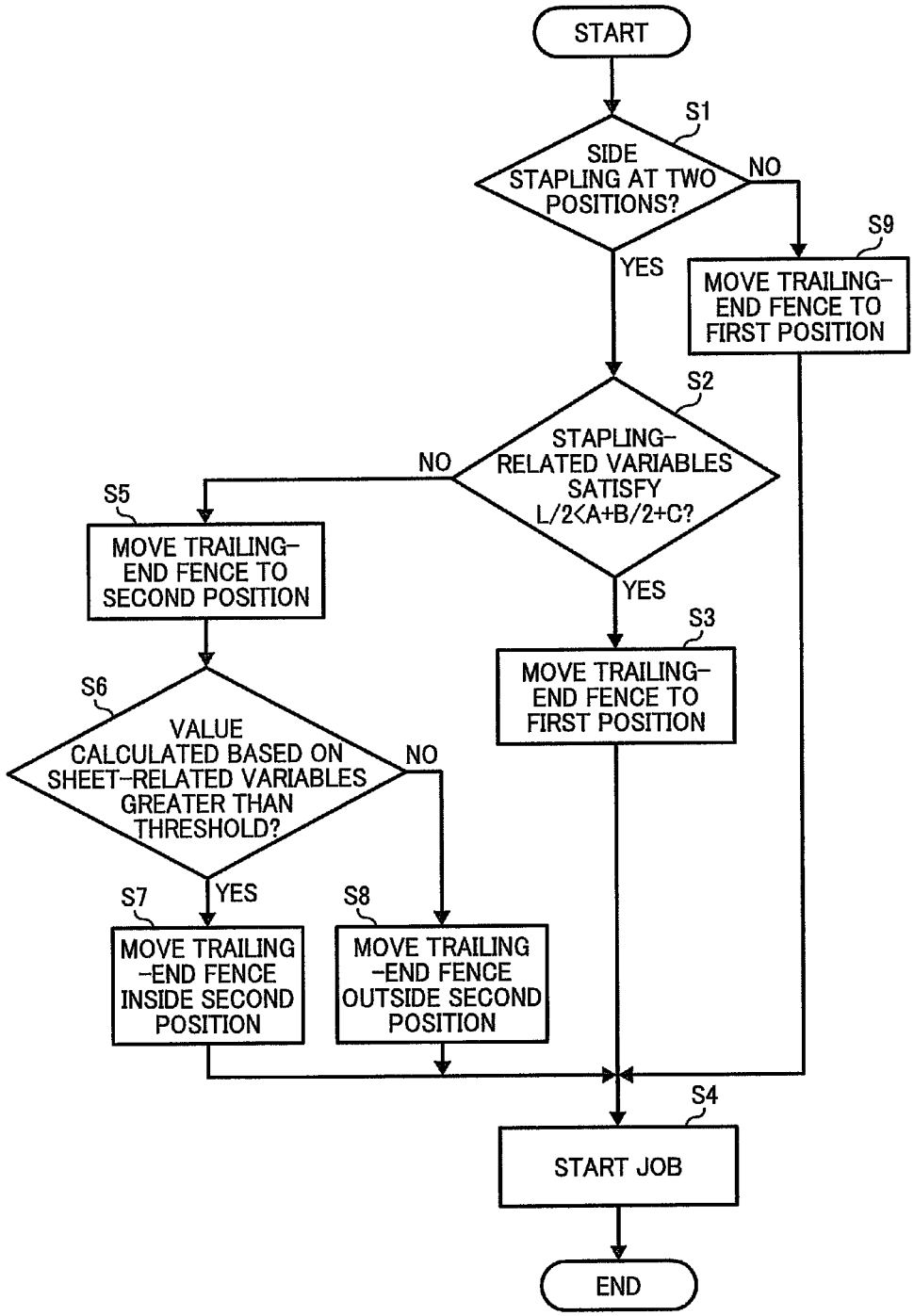
FIG. 16 is a flowchart illustrating a procedure of setting the position of the pair of trailing-end fences in the sheet width direction in the sheet processing apparatus.

FIG. 16 is a flowchart illustrating a procedure of positioning of the trailing-end fences 51 (51*a* and 51*b*) in the sheet width direction in the sheet processing apparatus PD.

Referring to FIG. 16, at S1, the control circuit checks whether stapling to be performed is side stapling at two positions. When side stapling at two positions is to be performed (Yes at S1), at S2 the control circuit checks the relation among stapling-related variables, namely, the length L of the stapled side of the bundle, the staple positions S1*c* (i.e., the distances A and B), and the length C of the stack portions 51*a*1 and 51*b*1 of the trailing-end fence 51 based on data received from the image forming apparatus PR. When the relation among the stapling-related variables satisfy formula 1, $L/2<A+B/2-C$ (Yes at S2), at S3 the right and left trailing-end fences 51*a* and 51*b* are moved so that the stack portions 51*a*1 and 51*b*1 are positioned at the first positions (inner positions) P1. At S4, the stapling job is started, and the sheet processing apparatus PD receives sheets from the image forming apparatus PR.

By contrast, if the relation among the stapling-related variables (L, A, B, and C) satisfy formula 2, $L/2\geqq A+B/2-C$ not formula 1, $L/2<A+B/2-C$ (No at S2), at S5 the right and left trailing-end fences 51*a* and 51*b* are moved so that the stack portions 51*a*1 and 51*b*1 are positioned at the second positions (outer positions) P2. Additionally, at S6 the control circuits checks the sheet-related variables received from the image forming apparatus PR. The sheet-related variables here include sheet size, sheet thickness, and sheet type. Sheet thickness and sheet type relate to the rigidity of the sheet. The rigidity of sheets increases as the sheet thickness increases and when the sheets are coated. In the case of rigid sheets, possibility of curling or bending is smaller, and inconveniences are not caused even if the distance from the contact position with the trailing-end fence 51 to the end of the bundle in the sheet width direction is relatively great.

Therefore, at S6 the CPU 111 checks whether at least one of the sheet-related variables (sheet data) is greater than the preset threshold. When the sheet-related variable is greater than the preset threshold (Yes at S6), at S7 the right and left trailing-end fences 51*a* and 51*b* are moved so that the stack portions 51*a*1 and 51*b*1 are positioned at the fourth positions P2*b* (shown in FIG. 14), which are inside the respective third positions P2*a* (shown in FIG. 13), or the outer positions P2 shown in FIG. 11. By contrast, when the sheet-related variable is not greater than the threshold, at S8 the right and left trailing-end fences 51*a* and 51*b* are moved so that the stack portions 51*a*1 and 51*b*1 are positioned at the third positions P2*a*, which are outside the respective fourth positions P2*b*, or the outer positions P2 shown in FIG. 11. Then, the stapling job is started at S4. As described above, the thresholds of the sheet-related variables can be experimentally preset and stored as a table in the RAM or EPROM, and the CPU 111 can refer to the table according to the data of the sheets to determine which of the thresholds is to be used.

It is to be noted that the first and second positions P1 and P2 are set for respective sheet sizes, and the third and fourth positions P2*a* and P2*b* are set according to the sheet-related variables (e.g., sheet size) for sheet sizes that are stapled at positions outside the trailing-end fence 51 in the direction perpendicular to the sheet conveyance direction. The first, second, third, and fourth positions P1, P2, P2*a*, and P2*b* may be either selected from prestored tables or calculated using simple formulas.

By contrast, if side-stapling at two position is not to be performed (No at S1), at S9 the right and left trailing-end fences 51*a* and 51*b* are moved so that the stack portions 51*a*1 and 51*b*1 are positioned at the inner positions P1. Then, at S4 the job is started.

As described above, in the present embodiment, before the job is started, the stack portions 51*a*1 and 51*b*1 of the right and left trailing-end fences 51*a* and 51*b* are moved to either the inner positions P1 inside the side stapler S1 or the outer positions P2 outside the stapler S1 in the sheet width direction according to the stapling-related variables, namely, the length L of the stapled side of the bundle of sheets, the staple positions (i.e., distance A), the length B of staples, and the length C of the stack portions 51*a*1 and 51*b*1 of the trailing-end fence 51 in the sheet width direction perpendicular to the sheet conveyance direction.

Further, the outer positions may be selected from multiple options. Alternatively, when the outer positions P2 are selected, the outer positions may be changed to, for example, either the third positions P2*a* farther from the staling positions and the fourth positions P2*b* closer to the stapled positions, according to the sheet-related variables. Therefore, the sheet processing apparatus PD can staple the bundle at proper positions without degrading alignment of the sheets and productivity.

Additionally, although the description above concerns side-stapling at two positions that are substantially symmetrical in the sheet width direction, the above-described features of the present embodiment can adapt to side-stapling at three positions in which two outer staples are symmetrical relative to a center staple in the sheet width direction perpendicular to the sheet conveyance direction.

Further, accuracy of the stapled positions and alignment of the sheets can be kept at desirable levels without reducing productivity by moving the pair of first aligning members to either the first position P1 or the second position P2 before the sheets are aligned on the side-stapling tray F.

Numerous additional modifications and variations are possible in light of the above teachings. It is therefore to be understood that, within the scope of the appended claims, the disclosure of this patent specification may be practiced otherwise than as specifically described herein.

What is claimed is:

1. A sheet processing apparatus comprising:

a pair of first aligning members movable in both a sheet conveyance direction in which a bundle of sheets is transported and a sheet width direction perpendicular to the sheet conveyance direction, the first aligning members each including a stack portion to contact and support a trailing edge of the bundle to align the trailing edge of the bundle;

a pair of second aligning members each extending in the sheet conveyance direction to move in the sheet width direction perpendicular to the sheet conveyance direction to align lateral sides of the bundle;

a stapler movable in the sheet width direction perpendicular to the sheet conveyance direction to staple a trailing end portion of the bundle with staples at different positions in the sheet width direction after the bundle is aligned by the pair of first aligning members as well as the pair of second aligning members;

a driving unit to move the pair of first aligning members; and a controller communicably connected to the stapler and the driving unit to move the first aligning members, wherein, when the stapler staples the bundle at two positions symmetrical relative to a center position in the sheet width direction of the bundle, the controller selects either first positions inside the two positions stapled symmetrically or second positions outside the two positions stapled symmetrically in accordance with multiple stapling-related variables, and the first aligning members are set at the selected positions to align the trailing edge of the bundle, the controller changes the second positions selected in accordance with the multiple stapling-related variables to positions either closer to the center position in the sheet width direction or farther from the center position in the sheet width direction in accordance with at least one of multiple sheet-related variables including a sheet size, a sheet thickness, a sheet type, and a rigidity of the sheet determined based on either the sheet type or the sheet type as well as the sheet thickness, the controller includes a storage unit to store a threshold for each of the multiple sheet-related variables, when one of the multiple sheet-related variables is greater than the threshold, the controller sets the first aligning members at third positions outside the second positions in the sheet width direction, and when one of the multiple stapling-related variables is smaller than the threshold, the controller sets the first aligning members at fourth positions inside the second positions in the sheet width direction.

2. The sheet processing apparatus according to claim 1, wherein the controller selects the second positions from multiple positions different in the sheet width direction in accordance with a sheet-related variable including at least one of a sheet size, a sheet thickness, and a sheet type.

3. The sheet processing apparatus according to claim 1, wherein the multiple stapling-related variables comprise a sheet size and positional data of stapled positions.

4. The sheet processing apparatus according to claim 3, wherein the positional data of stapled positions comprise an interval between the two positions stapled symmetrically.

5. The sheet processing apparatus according to claim 3, wherein the sheet size comprises a direction of the sheets.

6. The sheet processing apparatus according to claim 3, wherein the sheet size comprises a length of a trailing side of the bundle of sheets.

7. The sheet processing apparatus according to claim 6, wherein, when L represents the length of the trailing side of the bundle, A represents a distance from the center position of the bundle to one of the two positions stapled symmetrically in the sheet width direction, B represents a length of a staple to bind the bundle in the sheet width direction, and C represents a length in the sheet width direction of a range in which the first aligning member contacts the bundle, the controller sets the first aligning members at the first positions when $L/2<A+B/2+C$ is satisfied and at the second positions when $L/2\geqq A+B/2+C$ is satisfied.

8. The sheet processing apparatus according to claim 1, wherein the stapler comprises:

a stitcher to drive staples into the bundle of sheets; and a clincher to bend both end portions of the staples discharged by the stitcher, positioned at an interval from the stitcher, wherein the interval between the stitcher and the clincher is sufficient for the first aligning members to move therethrough.

9. The sheet processing apparatus according to claim 1, wherein, the controller causes the driving unit to move the first aligning members to either the first positions or the second positions before the bundle of sheets is aligned.

10. The sheet processing apparatus according to claim 1, wherein each of the second aligning members comprises a support portion to support a lateral side portion of the bundle of sheets from the bottom side of the bundle.

11. An image forming system comprising:

an image forming apparatus to form images on sheets of recording media; and the sheet processing apparatus according to claim 1.

12. A method of processing a bundle of sheets, the method comprising:

presetting, as a pair of positions at which a trailing end portion of the bundle is supported, first positions inside two positions stapled symmetrically to a center position in a sheet width direction perpendicular to a sheet conveyance direction and second positions outside the two positions stapled symmetrically in the sheet width direction according to sheet size and positional data of stapled positions;

selecting either the first positions inside the two positions stapled symmetrically or the second positions outside the two positions stapled symmetrically in accordance with multiple stapling-related variables;

changing the second positions in accordance with the multiple stapling-related variables to positions either closer to the center position in the sheet width direction or farther from the center position in the sheet width direction in accordance with at least one of multiple sheet-related variables including a sheet size, a sheet thickness, a sheet type, and a rigidity of the sheet determined based on either the sheet type or the sheet type as well as the sheet thickness;

storing a threshold for each of the multiple sheet-related variables, setting third positions outside the second positions in the sheet width direction when one of the multiple sheet-related variables is greater than the threshold;

setting fourth positions inside the second positions in the sheet width direction when one of the multiple stapling-related variables is smaller than the threshold;

moving a pair of first aligning members to one of the first positions, the second positions, the third positions and the fourth positions before the bundle of sheets are aligned on the sheet support;

aligning the bundle of sheets in the sheet conveyance direction with the pair of first aligning members;

aligning the bundle of sheets in the sheet width direction with a pair of second aligning members; and stapling the trailing end portion of the bundle of sheets at the two positions stapled symmetrically.

* * * * *